US005993034A

United States Patent [19]

Kace, Jr. et al.

[11] Patent Number: 5,993,034

[45] Date of Patent: Nov. 30, 1999

[54] LAMP REFLECTOR FOR USE WITH GASEOUS DISCHARGE LIGHTING

[75] Inventors: Frank Paul Kace, Jr., Hillsboro, N.H.; Robert L. King, Seymour, Ind.; Robert J. Schmitt, Jr., Nottingham; Richard J. Smaglick, Concord, both of N.H.; Yakov G. Soskind; Mark A. Verplank, both of Columbus, Ind.; Douglas A. Waltrip, Seymour, Ind.

[73] Assignee: Valeo Sylvania L.L.C., Seymour, Ind.

[21] Appl. No.: 08/803,930

[22] Filed: Feb. 21, 1997

[51] Int. Cl.[6] ..... F21V 7/09; F21S 3/00

[52] U.S. Cl. ..... 362/517; 362/222; 362/265; 362/300; 362/310

[58] Field of Search ..... 362/516, 517, 362/217, 221–224, 265, 267, 299, 300, 310, 327

[56] References Cited

U.S. PATENT DOCUMENTS

| | | | |
|---|---|---|---|
| 1,826,927 | 10/1931 | Exelmans | 362/223 |
| 1,913,517 | 6/1933 | Smith | 362/217 |
| 2,316,546 | 4/1943 | Anderson et al. | 362/222 |
| 2,632,842 | 3/1953 | Grupen et al. | 362/300 |
| 2,740,103 | 3/1956 | Gosswiller | 362/300 |
| 3,588,492 | 6/1971 | Pollock | 362/309 |
| 4,150,422 | 4/1979 | Peralta | 362/218 |
| 4,349,866 | 9/1982 | Molnar | 362/300 |
| 4,947,292 | 8/1990 | Vlah | 362/551 |
| 5,093,767 | 3/1992 | Burn | 362/217 |
| 5,471,371 | 11/1995 | Koppolu | 362/555 |

*Primary Examiner*—Alan Cariaso
*Attorney, Agent, or Firm*—William E. Meyer

[57] ABSTRACT

A reflector is provided which surrounds a light source that has emissions in both the visible and radio frequency ranges. The electrically conductive reflecting coating of the reflector is connected to the system electrical ground so that the radio frequency component is effectively shielded by the reflector. The visible component of the spectrum emitted by the source escapes the reflector cavity after at least one reflection from the reflector surface and forms the required beam pattern.

23 Claims, 6 Drawing Sheets

LAMP REFLECTOR FOR USE WITH GASEOUS DISCHARGE LIGHTING

BACKGROUND OF THE INVENTION

1. Field of the Invention

This invention relates to a lighting device, specifically to a lamp reflector used with gas discharge light sources. More particularly, the invention is directed to a reflector design intended to suppress radio frequency electro-magnetic radiation from a light source.

2. Description of the Prior Art

Heretofore, EMI (electro-magnetic interference) from a source of EMR (electro-magnetic radiation) has been suppressed by shielding that source. Opaque materials such as metals, metal filled plastics or metallic coatings are used for EMI shielding of electronic components, ballasts, etc.

Discharge light sources emitting in the visible spectral range, generate a certain amount of EMR due to the nature of the processes in the source and its excitation. The level of that EMR could cause serious interference with electronic devices. One example of such a source is a neon light tube.

Opaque shielding materials are not applicable, since they would not pass the visible radiation.

To provide EMI shielding for sources of this nature, woven metal wire meshes with small cell size are widely used. Disadvantages of this approach include increased cost and performance limitations. Regarding increased costs, the addition of the wire mesh increases both component and assembly cost, affecting the overall cost of the finished product.

Regarding performance limitations, the size of the mesh cells applies limitation on the high frequency range that can be efficiently shielded, and reduces the light output due to absorption and scattering from the mesh.

Another technique of EMI shielding is the use of conductive coatings that are transparent in the visible range. ITO (Indium Tin Oxide) is widely used. Although this technique does not have the performance limitations mentioned above, the application of the coating is expensive, and the coating itself is highly toxic.

SUMMARY OF THE INVENTION

It is the essential object of the present invention to reduce the overall cost of the device by eliminating the special EMI-shielding component. It is an object to achieve this goal without using a radio frequency screen, such a screen typically reducing the light by about 20%. It is also an object to achieve this goal using a lamp having low wattage rating. The goals are achieved by providing a lighting device comprising of a reflector that completely surrounds the light source so that there is no direct light emanating from the source. The visible spectral component of the source is escaping from the reflector cavity after at least being once reflected. This reflector surface is grounded so that the EMR is effectively shielded by the same reflector surface. The reflector is composed from several individual portions that are relatively aligned for best performance, as shown in the embodiments. In order to afford a clearer understanding of this invention and of the manner in which the same may be carried out in actual practice, two typical forms of embodiments thereof will be described by way of example with reference to the accompanying drawings.

BRIEF DESCRIPTION OF THE DRAWINGS

This invention may be clearly understood by reference to the attached drawings wherein like elements are designated by like reference numerals and in which.

DESCRIPTION OF THE PREFERRED EMBODIMENT

Figure 1:
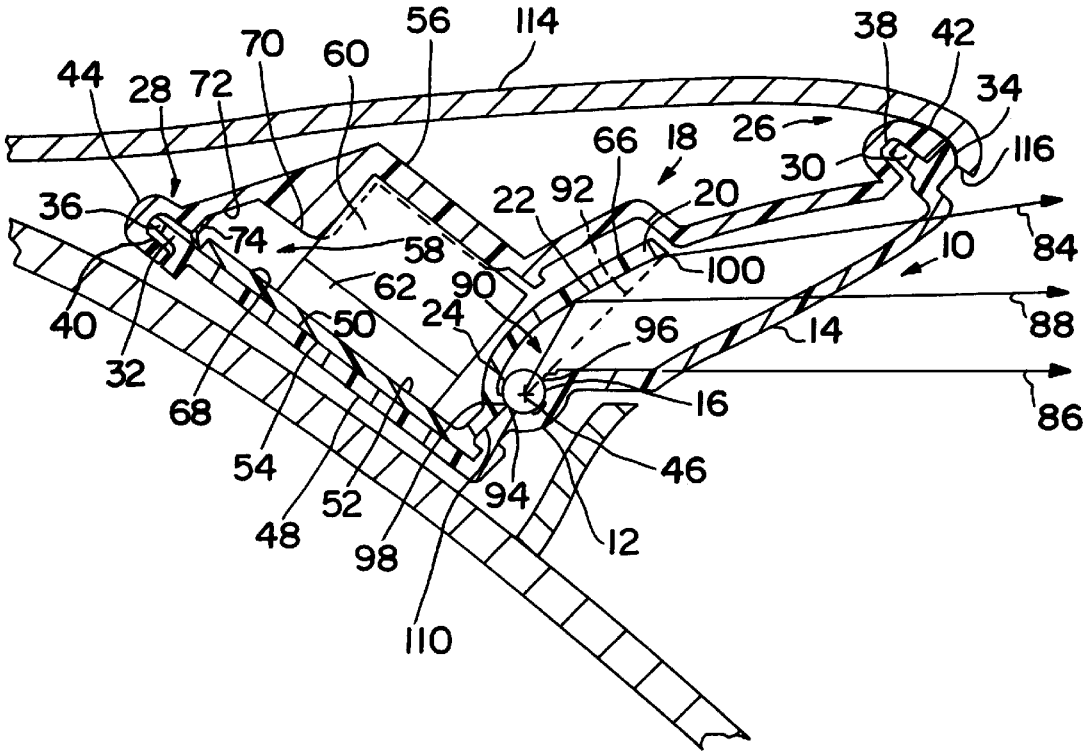
FIG. 1 is a cross-sectional view of one embodiment of a lamp assembly of the present invention in a plane perpendicular to the axis of discharge of a lamp of such assembly.

The embodiment of this invention which is illustrated in FIG. 1 is particularly suited for achieving the objects of this invention. The present invention relates to a lamp assembly which comprises a housing and an elongated lamp mounted to the housing, the housing including a first element connected to a second element, and the elongated lamp being mounted therebetween. For example, in the embodiment of FIG. 1, a first element 10 is provided which includes a lens having a trough portion 12 and a transparent lens portion 14. The trough portion 12 comprises a reflective metallized inner surface 16. In the embodiment of FIG. 1, the first element 10 is made from a transparent plastic material which may be, for example, a red polycarbonate. In order to metallize the inner surface 16 of the trough portion 12, the surface 16 may be covered with a reflective metallized material such as aluminum, the lens portion 14 being left transparent by not applying such aluminum thereto. The aluminum may be applied to the inner surface 16 by coating, if desired. It should be noted that all of the metallized surfaces described herein comprise a radio frequency absorbing material such as, for example, aluminum, which may be applied by coating.

The housing of the lamp assembly of the present invention also includes a second element. The second element may include a single plastic piece which includes a backing portion and a reflector portion or may be formed from two separate pieces which form a backing portion and a reflector portion, repectively, which are coupled together. In the embodiment of FIG. 1 the second element 18 is formed from two separate pieces. One piece is the reflector portion 20 having a reflective metallized surface 22 which faces the metallized surface 16 of the trough portion 12 and the transparent lens portion 14. An elongated lamp 24 is mounted to the housing and extends in the trough portion 12.

In the preferred embodiment, the first element and the second element are connected and hermetically sealed together by tongue and groove segments at respective edge segments of the housing. For example, in the embodiment of FIG. 1, the first element 10 and the second element 18 are connected together by tongue and groove segments 26 and 28. To this end, first element 10 includes tongue members 30 and 32 at opposite edge segments 34 and 36 of the first element, and second element 18 includes respective mating groove members 38 and 40 at opposite edge segments 42 and 44 of the second element. In the preferred embodiment, the first and second elements 10, 18 may be connected together in this manner such that the reflective metallized surfaces 16 and 22 form a reflector having a predetermined reflective pattern. A sealing adhesive (not shown) may be provided at the tongue and groove interfaces to adhere and hermetically seal together the first element 10 and second element 18. In the embodiment depicted in FIG. 1, elongated lamp 24 has an axis of discharge 46. The predetermined reflective pattern lies in a plane perpendicular to the axis of discharge 46 and forms a spiral relative to the axis of discharge. The predetermined reflective pattern is described in more detail hereinafter.

Figure 2:
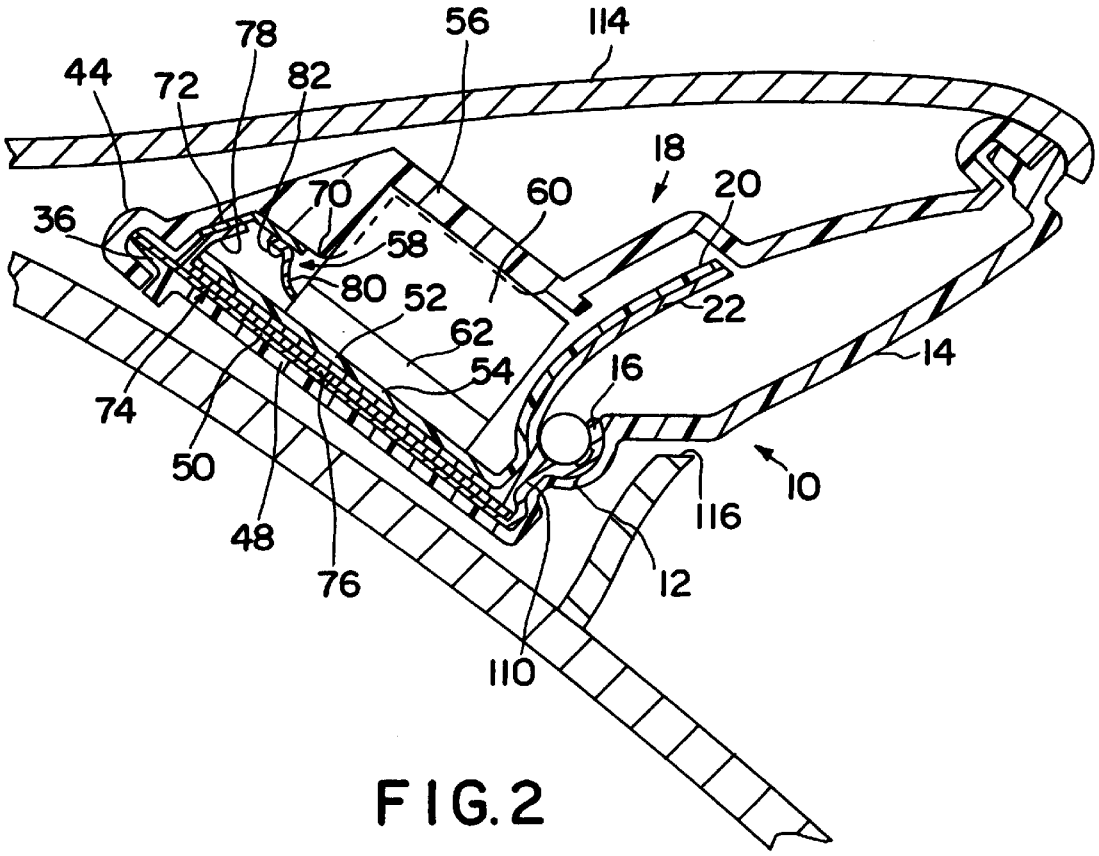
FIG. 2 is a more detailed enlarged view of FIG. 1.

In considering FIGS. 1 and 2, the first element 10 includes a leg portion 48 which extends from the trough portion 12 to the edge segment 36. The leg portion 48 has a radio frequency absorbing inner surface such as a metallized inner surface 50 which extends from the metallized surface 16 towards the end of the leg portion 48. In a like manner, the second element 18 includes a leg portion 52 which extends from the reflector portion 20 towards the edge segment 44. The leg portion 52 has a radio frequency absorbing inner surface such as a metallized inner surface 54 which extends from the metallized surface 22 towards the end of the leg portion. In the assembled housing of FIGS. 1 and 2, the metallized surface 50 faces, and is in close proximity to, the metallized surface 54.

Figure 3:
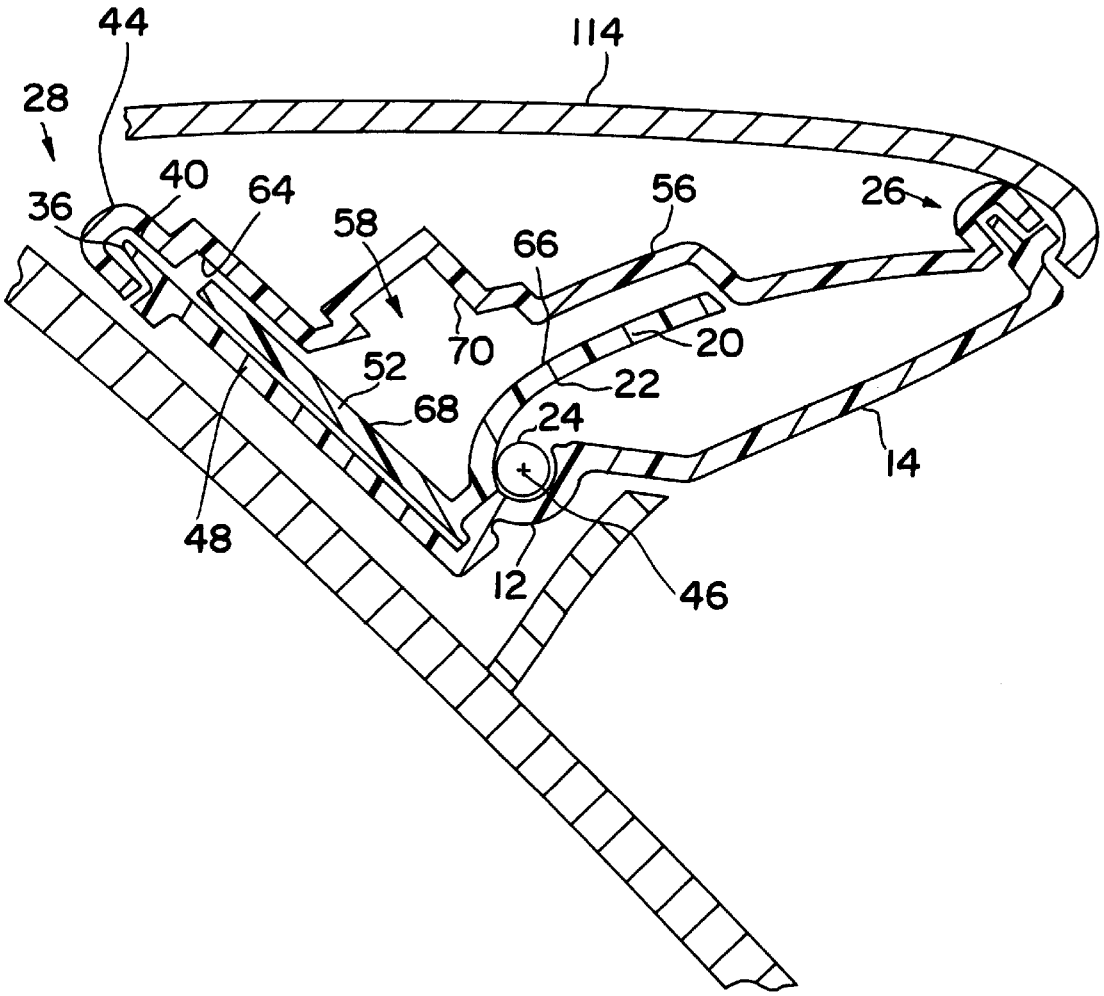
FIG. 3 is a cross-sectional view similar to FIG. 1 but taken at a different location along the axis of discharge of the lamp.

In the preferred embodiment, the second element 18 comprises a separate backing portion 56. The reflector portion 20 extends away from the backing portion 56 to form a cavity 58 between the reflector portion 20 and the backing portion. A ballast member 60 is mounted in cavity 58. For example, cavity 58 may comprise a recess 62 into which a mating ballast member 60 may be inserted. Recess 62 may be provided on the backing portion 56, or as depicted in the drawings, on the inner surface of the leg portion 52. A radio frequency absorbing surface may be provided at the inner surface of the leg portion 52 around the ballast recess. For example, such area may be provided with a metallized surface. As illustrated in FIG. 3, which is a cross-sectional view of the lamp assembly of the embodiment of the present invention depicted in FIG. 1 taken at another location along the axis of discharge 46, the reflector portion 20 is held in place relative to the backing portion 56 and the lens portion 14 by sandwiching the leg portion 52 extending from the reflector portion 20 between the leg portion 48, extending from the trough portion 12, and an inner surface 64 of the backing portion 56.

In the preferred embodiment, the cavity 58 comprises an inner boundary formed by inner surfaces 66, 68 and 70 of the reflector portion 20, leg portion 52 and backing portion 56, respectively. The inner boundary comprises a radio frequency absorbing surface such as an inner boundary metallized surface. For example, as illustrated in FIGS. 1 and 2, a portion of inner surface 70 of the backing portion 56 forms a metallized surface 72. In the preferred embodiment, a conductive member is electrically connected between the inner boundary metallized surface, on the one hand, and the metallized surfaces 50 and 54, on the other. To this end, such conductive member is preferably sandwiched between the metallized surfaces 50 and 54. For example, as best illustrated in FIG. 2, a stainless steel clip 74 is provided. Clip 74 includes a first arm 76 and second arm 78 which extends from, and is spring-biassed away from, the first arm. The first arm 76 is sandwiched between the metallized surfaces 50 and 54, and the second arm 78 extends into cavity 58 and is spring-biassed into engagement with the inner boundary metallized surface 72. Ballast member 60 includes two conductors (not shown) electrically connected to opposite ends of the elongated lamp 24, and a ground conductor 80 electrically and mechanically connected to the inner boundary metallized surface 72 by screw 82. In this manner, the radio frequency absorbing materials formed about the ballast recess 62, on the backing 56 at 72, between leg portions 48, 52 at 50, 54, and on the reflector surface 22 and trough surface 16, may be coupled to the system electrical ground (not shown) to intercept all radio frequency broadcast before transmission through the lamp gap.

In considering the predetermined reflective pattern provided by the metallized surfaces 16 and 22, a non-imaging optical set-up is provided which includes a reflector which effectively completely surrounds the elongated lamp 24 so that there is no direct light emanating from the source. With reference to FIG. 1, the visible spectral component of the lamp 24 comprises a maximum upper beam component 84, a maximum lower beam component 86 and a center beam component 88, the center beam component being approximately horizontal. Such visible spectral component of lamp 24 escapes from the reflector cavity 90 and through the lamp gap 92 after at least being once reflected.

In the embodiment illustrated in FIG. 1, the lamp assembly may comprise a lamp 24 which is a low wattage, elongated neon discharge lamp tube which emits light and radio frequency noise. Such lamp may be a 7 watt, 50 torr neon lamp which is fabricated from a gas filled tube having an inner diameter of 3 mm, an outer diameter of 5 mm and a length which extends in the direction of axis 46 of about 14 inches. The pulse rate is 15 kHz. Such a low wattage lamp has low heat production. As a result, the elongated lamp can be cradled by small protuberances extending from the trough portion 12 and the reflector portion 20 which allows both optimum centering of the lamp and close spacing between the lamp and metallized reflective surfaces. Such positioning of the lamp facilitates efficient trapping of all of the light and radio frequency. Such a configuration allows efficient radiation of the small level of light produced and good capture of the radio frequency.

Elements 10 and 18 provide a sealed housing which encloses the lamp tube. The lens includes the lens portion 14 and the reflective trough portion 16 which extend approximately the length of lamp 24. Trough 16 has a first edge 94 and a second edge 96. Reflector portion 20 has an inner edge 98 and an outer edge 100. Inner edge 98 is positioned adjacent the lens along the first edge 94. The reflector portion 20 curves across and away from the trough 16 so that the outer edge 100 at least intersects a plane which extends through the first edge 94 and the outer edge while providing no direct line of sight to the trough. The large tube 24 is axially centered in trough 16 and is offset from the lens portion 14 and the reflector portion 20. The backing portion 56 is sealed to the lens along edges 42 and 44 to enclose the reflector portion 20 and define the cavity 58 which provides a wireway and the ballast recess 62 between the backing portion and the reflector portions. The light reflective material of surface 16 is formed on the inner surface of the lens between edges 94 and 96, and the light reflective material of surface 22 is formed between edges 98 and 100. Some advantage has been found in extending the grounding material from edge 96 around the corner toward lens 14. This is believed to accomodate a small surface conductance around the corner. As depicted in FIG. 1, reflective material at surfaces 16 and 22 directs emitted visible light through the gap 92 between edges 96 and 100. Such light may be directed, for example, in a direction extending about 10 degrees about the horizontal beam 88.

In the preferred embodiment, metallized surfaces 16 and 22 comprise several individual portions that are relatively aligned for best performance. For example, in the embodiment schematically depicted in FIG. 4, the reflector component formed by metallized surfaces 16 and 22 is composed of four individual surfaces including a first surface 102 which is part of a parabolic cylinder, a second surface 104 which is part of a circular cylinder, and third and fourth surfaces 106 and 108 which are part of a spiral cylinder, or in the alternative, part of an elliptical cylinder. In combining such individual surfaces, it will be readily apparent to those skilled in the art that the specific location of the break 110 between the metallized surfaces of the first element 10 and second element 18 will depend upon the design and dimensions chosen and will not affect the operation of the reflector component collectively formed by surfaces 16 and 22. Therefore, break 110 is not depicted in FIGS. 3 to 5.

In considering the reflector components of FIG. 3, as noted herein elongated lamp 24 may be a neon lamp comprising a gas filled tube 24' having a diameter that is substantially smaller than the length of the tube. As noted, the diameter of the tube may be as small as, for example, 3 mm (inner diameter) and 5 mm (outer diameter). Such a characteristic implies one dimensioned reflector design wherein the reflector components may be obtained by sweeping a line parallel to the axis 46 of the lamp 24 along a composite curve to form a generally spiral pattern in a plane which is perpendicular to axis 46. Axis 46 is the axis of the discharge of lamp 24.

Figure 4:
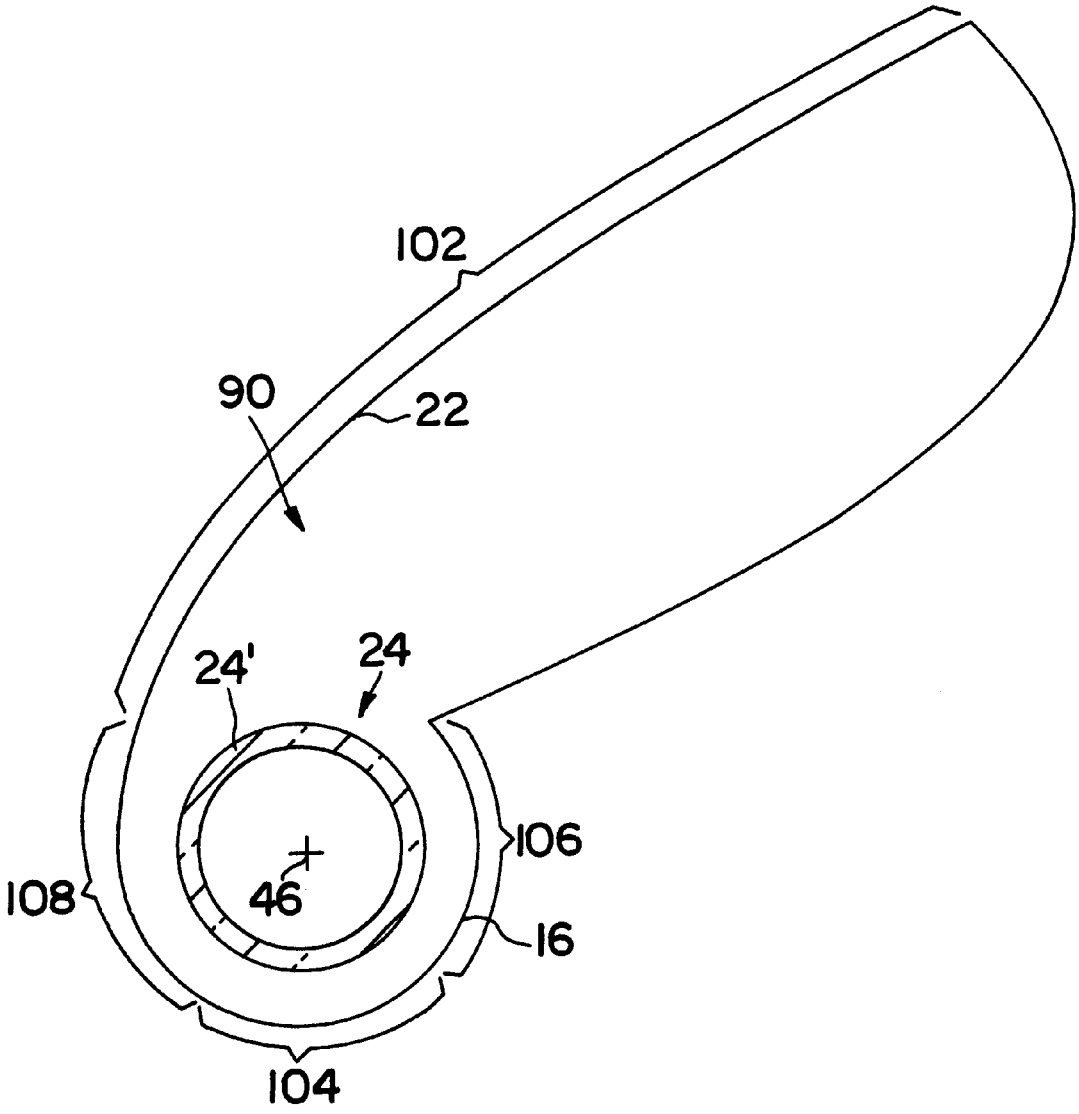
FIG. 4 is a cross-sectional schematic view of reflector components of one embodiment of the present invention in a plane perpendicular to the axis of discharge of a lamp associated with such reflector components.
Figure 5:
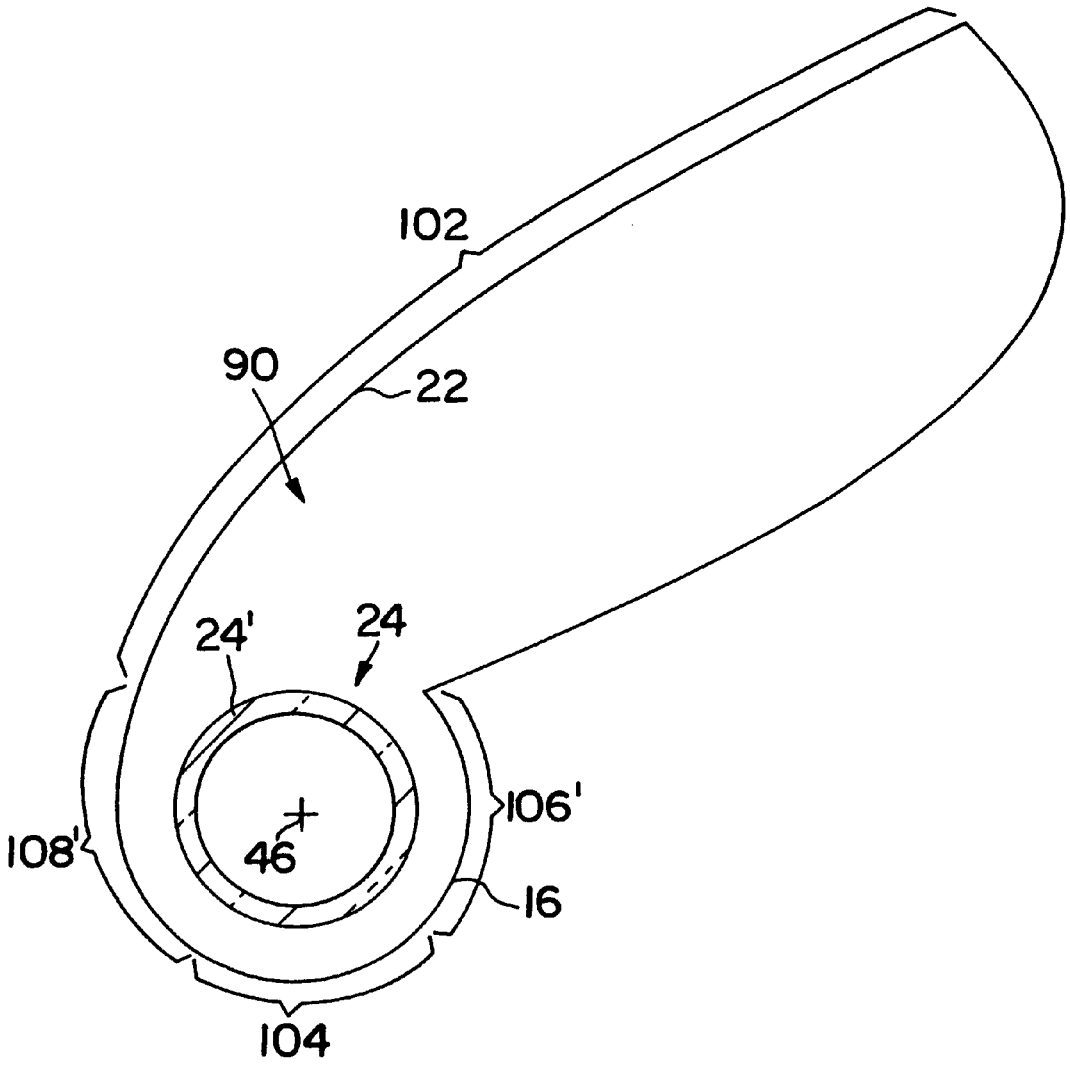
FIG. 5 is a cross-sectional schematic view similar to FIG. 4 wherein the reflector components comprise surfaces which are part of parabolic, circular and spiral cylinders.

In the embodiment schematically depicted in FIG. 5, a reflector of the type depicted in FIG. 4 is provided wherein spiral surfaces which are part of a spiral cylinder are utilized. In particular, metallized surfaces 16 and 22 collectively consist of individual surfaces including a first surface 102 which is part of a parabolic cylinder, a second surface 104 which is part of a circular cylinder and opposes surface 102, and third and fourth surfaces 106' and 108' which are part of a spiral cylinder. Surfaces 102, 104, 106' and 108' are connected as depicted in FIG. 5 into one continuous composite curve. In fabricating the reflector of FIG. 5, the focal point of the parabola associated with the surface 102 and the center of curvature of the circle associated with the surface 104 are located within the inner diameter of the glass tube 24'. In the preferred embodiment, such parabolic focal point and center point of the circular arc is the centerline of the discharge; that is, the axis 46 of lamp 24. The spiral surfaces 106' and 108' force the light emitted by lamp 24 not being initially intercepted by parabolic surface 102 or circular surface 104, to escape the reflector cavity 90 via multiple reflections from reflector surfaces.

Figure 6:
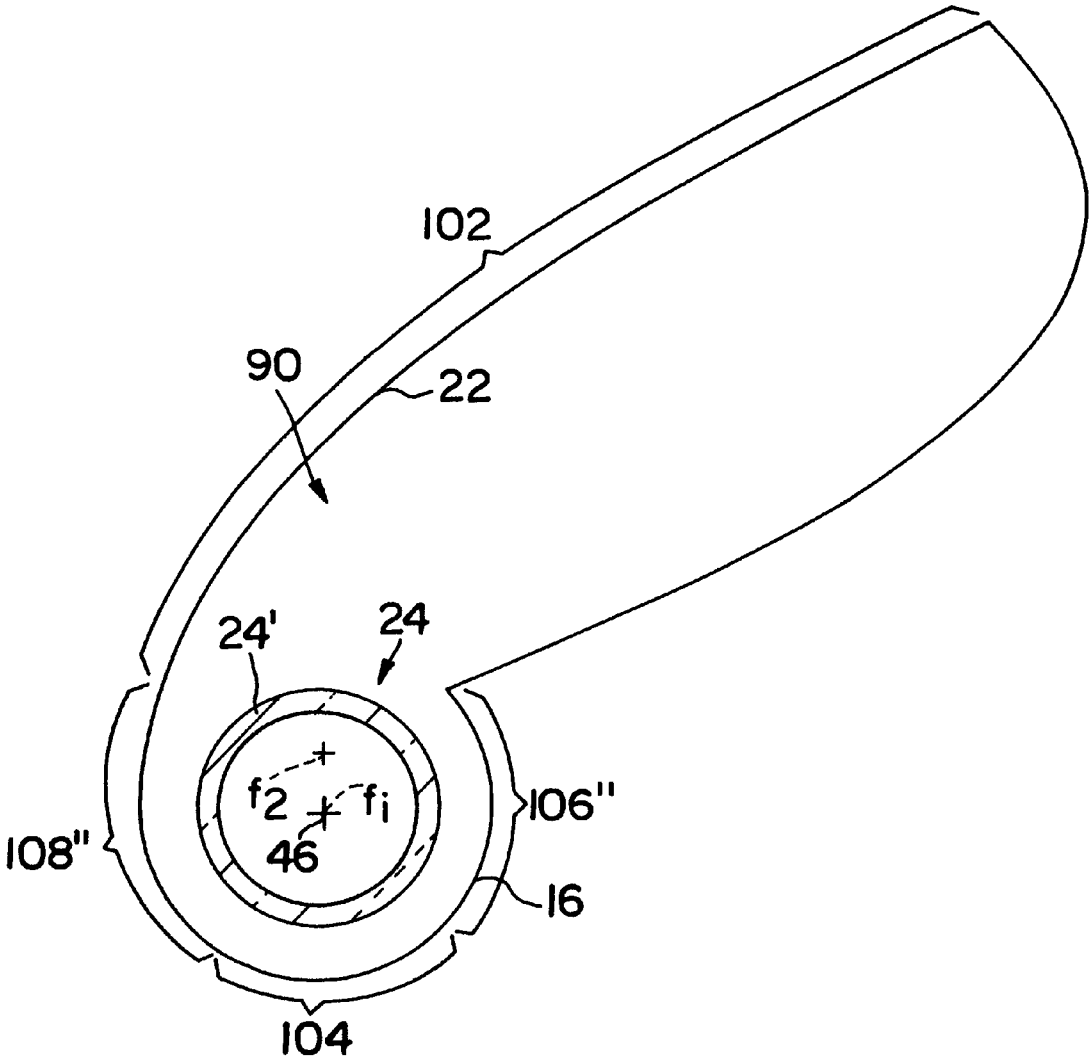
FIG. 6 is a cross-sectional schematic view similar to FIG. 4 wherein the reflector components comprise surfaces which are part of parabolic, circular and elliptical cylinders.

The embodiment depicted schematically in FIG. 6 is identical to that of FIG. 5 with the exception that spiral-type surfaces 106' and 108' are replaced by surfaces 106" and 108" which are part of an elliptical cylinder. In fabricating the reflector of FIG. 6, the elliptical surfaces 106" and 108" are aligned so that foci $f_1$ of elliptical surface 106" coincides with the centerline of the discharge, which as noted is the axis 46 of lamp 24, and the foci $f_2$ of elliptical surface 108" is displaced vertically above the centerline. The elliptical surfaces 106" and 108" force the light emitted by lamp 24, not being initially intercepted by parabolic surface 102 or circular surface 104, to escape the reflector cavity 90 via multiple reflections from reflector surfaces.

FIG. 1 schematically illustrates the lamp assembly of the present invention placed in a spoiler 114 of a vehicle (not shown) to provide a signal lamp for the vehicle. The transparent lens portion 14 provides an output window for the light emitted by lamp 24, and in the preferred embodiment such output window will follow the contours of the spoiler 114. To this end, the lamp assembly may be inserted into a spoiler recess 116 which is configured to effect such a result. When provided for use with a vehicle, the lamp assembly of the present invention will comprise reflector components which will be aligned as described herein to achieve the necessary output light distribution complying to automotive signal lighting specifications.

In considering the present invention, a lamp assembly is provided wherein the reflector surrounds the tubular neon light source so that there is no direct radiation emitted by the source escaping the reflector cavity. The reflective coating, applied to the reflector component, is connected to the system electrical ground. That assures that any direct EMR emitted by the source media is effectively absorbed by the conductive reflector coating assuring effective shielding of the EMR component of the emitted spectrum. At the same time, the visible part of the emitted spectrum is reflected by the reflector coating and exits the reflector opening after at least one reflection from the reflector surfaces. The rays from the source emitted towards the parabolic portion of the reflector exit the lamp after one reflection from the reflector surface. The rays from the source emitted towards the circular portion of the reflector are reflected back through the neon tube towards the parabolic portion of the reflector surface and exit the lamp after two reflections from the reflector surfaces. The rays from the source emitted towards the spiral portions of the reflector in the embodiment of FIG. 4, or elliptical portions in the embodiment of FIG. 5, bounce between the reflector surfaces and exit the reflector after several reflections. FIG. 1 shows the light distribution from the lamp ray-trace model according to the present invention employing a neon tube with intensity of 11.7 CD in a direction orthogonal to the axis (centerline) of the source. The output light distribution complies with the requirements of FMVSS 108 for CHMSL (center high mounted stop lamp) applications.

Accordingly it can be seen that the reflector, according to the present invention, eliminates the need for any additional EMI shielding element, effectively reducing the cost of the entire assembly. Although the description above contains many specifics, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A lamp assembly, comprising:

a housing including a first element connected to a second element, said first element having a trough portion and a transparent lens portion, said trough portion including a reflective first metallized surface, and said second element comprising a reflector portion having a reflective second metallized surface facing said first metallized surface and said transparent lens portion; and an elongated lamp mounted to said housing and extending in said trough portion wherein said first element comprises a first leg portion having a third metallized surface extending from said first metallized surface, and said second element comprises a second leg portion having a fourth metallized surface extending from said second metallized surface, said third metallized surface facing and in close proximity to said fourth metallized surface, and further including a ballast member electrically connected to said elongated lamp and grounded to at least one of the first, second, third and fourth metallized surfaces.

2. The lamp assembly of claim 1 wherein said second element comprises a backing portion and said reflector portion, said reflector portion extending away from said backing portion forming a cavity between said backing portion and said reflector portion, said ballast member being mounted in said cavity.

3. The lamp assembly of claim 2 wherein said cavity comprises an inner boundary which comprises an inner boundary metallized surface, and further comprising a conductive member electrically connected between (a) said third metallized surface and said fourth metallized surface, and (b) said inner boundary metallized surface.

4. The lamp assembly of claim 3 wherein said conductive member is in contact with, and sandwiched between, said third metallized surface and said fourth metallized surface.

5. The lamp assembly of claim 4 wherein said conductive member comprises a spring-biassed clip having a first arm sandwiched between said third metallized surface and said fourth metallized surface, and a second arm extending from said first arm and into said cavity, said second arm being spring biassed against said inner boundary metallized surface.

6. The lamp assembly of claim 5 wherein said first element and said second element are connected together by tongue and groove segments such that said first metallized surface and said second metallized surface form a reflector having a predetermined reflective pattern.

7. The lamp assembly of claim 6 wherein said predetermined reflective pattern is a spiral.

8. A vehicle warning lamp comprising:

a) a low wattage, elongated neon discharge lamp tube emitting light and radio frequency noise and having a length along an axis, b) a sealed housing enclosing the lamp tube, comprising:

a lens having a lens portion and a reflective trough portion extending approximately the length of the lamp tube, the reflective trough portion having a first edge and a second edge, a reflector portion having an inner edge and an outer edge, the inner edge positioned adjacent the lens along the first edge, the reflector portion curving across and away from the trough portion so that the outer edge at least intersects a plane extended through the first edge and the outer edge while providing no direct line of sight from the exterior to the lamp tube, the lamp tube being axially centered in the trough portion and offset from the lens portion and the reflector portion, and a back portion sealed along an edge to the lens to enclose the reflector portion and to define a wireway between the backing portion and the reflector portion, the backing portion further including a ballast recess, c) visible light reflecting and radio frequency absorbing material formed on the lens between the first edge and the second edge, and formed on the reflector portion between the inner edge and the outer edge, to direct emitted visible light through a gap between the second edge and the outer edge in a direction extending at an angle about the horizontal, d) radio frequency absorbing material formed on the backing portion around the ballast recess and along a portion adjacent the wireway, said radio frequency absorbing material formed on the backing portion around the ballast recess, along a portion adjacent the wireway, on the lens between the first edge and the second edge, and on the reflector portion between the inner edge and the outer edge, being coupled to an electrical ground to intercept all radio frequency broadcast before transmission through the gap, e) a ballast positioned in the ballast recess, and f) electrical coupling wires extending from the ballast through the wireway to the lamp.

9. The vehicle warning lamp of claim 8 wherein the angle is about 10 degrees.

10. The vehicle warning lamp of claim 8 wherein the ballast is coupled to the radio frequency absorbing material.

11. The vehicle warning lamp of claim 8 wherein the lens and the backing portion are connected together by tongue and groove segments such that the portion of the lens between the first edge and the second edge, and the portion of the reflector between the inner edge and the outer edge, form a reflector component having a predetermined reflector pattern.

12. The vehicle warning lamp of claim 11 wherein said predetermined reflective pattern is a spiral.

13. The vehicle warning lamp of claim 12 wherein said predetermined reflective pattern is formed by visible light reflecting material formed on four individual surfaces of the reflector portion and the lens portion connected into one continuous composite surface which includes successively, from the outer edge of the reflector portion to the second edge of the lens, a first surface which is part of a parabolic cylinder, a second surface which is part of a spiral cylinder, a third surface which is part of a circular cylinder and a fourth surface which is part of a spiral surface.

14. The vehicle warning lamp of claim 12 wherein said predetermined reflective pattern is formed by visible light reflecting material formed on four individual surfaces of the reflector portion and the lens portion connected into one continuous composite surface which includes successively, from the outer edge of the reflector portion to the second edge of the lens, a first surface which is part of a parabolic cylinder, a second surface which is part of a elliptical cylinder, a third surface which is part of a circular cylinder and a fourth surface which is part of a elliptical surface.

15. The vehicle warning lamp of claim 8 further including a conductive spring-biassed clip having a first arm which is electrically connected to the radio frequency absorbing material formed on the lens and on the reflector portion, and a second arm which extends into the wireway and is spring-biassed against the radio frequency absorbing materials formed on the portion adjacent the wireway, the ballast being grounded to the radio frequency absorbing material formed on the portion adjacent the wireway.

16. The lamp assembly of claim 1 wherein said predetermined reflective pattern is formed by visible light reflecting material formed on four individual surfaces of the reflector portion and the lens portion connected into one continuous composite surface which includes successively, from the outer edge of the reflector portion to the second edge of the lens, a first surface which is part of a parabolic cylinder, a second surface which is part of a spiral cylinder, a third surface which is part of a circular cylinder and a fourth surface which is part of a spiral surface.

17. The lamp assembly of claim 1 wherein said predetermined reflective pattern is formed by visible light reflecting material formed on four individual surfaces of the reflector portion and the lens portion connected into one continuous composite surface which includes successively, from the outer edge of the reflector portion to the second edge of the lens, a first surface which is part of a parabolic cylinder, a second surface which is part of a elliptical cylinder, a third surface which is part of a circular cylinder and a fourth surface which is part of a elliptical surface.

18. A lamp assembly comprising:

an elongated lamp having an axis;

a housing having one or more first wall portions radially offset from the axis, the wall portions having interior surfaces defining an interior cavity enclosing the lamp, the wall portions collectively extending from a first edge parallel to the lamp axis around the lamp to a second edge also parallel to the lamp axis such that no sightline from the lamp passes directly to the exterior, the first edge being radially offset form the second edge thereby defining a radial gap between the first edge and the second edge, the interior surfaces being formed to reflect visible light from the lamp through the gap; the interior surfaces being further formed from electrically conductive material, and being grounded to intercept, and ground radio frequency interference radiation emitted by the lamp;

a visible light transmissive lens positioned across the gap to close the interior cavity; and a ballast enclosed in the housing by second wall portions such that all straight lines from the ballast to the exterior pass through the second wall portions, the second wall portions formed with electrically conductive material and are grounded to intercept, and ground radio frequency interference radiation emitted by the ballast.

19. The assembly in claim 18, wherein a section of the first wall portions comprises a section of a circular cylinder coaxial with the lamp axis.

20. The assembly in claim 18, wherein a section of the first wall portions comprises a section of a parabolic cylinder with an axis at the foci of the parabola being coaxial with the lamp axis.

21. The assembly in claim 18, wherein the housing comprises a first element connected to a second element, said first element having a trough portion and a transparent lens portion, said trough portion including a reflective first metallized surface, and said second element comprising a reflector portion having a reflective second metallized surface facing said first metallized surface and said transparent lens portion; and an elongated lamp mounted to said housing and extending in said trough portion.

22. The lamp assembly of claim 21 wherein said first element and said second element are connected together by tongue and groove segments such that said first metallized surface and said second metallized surface form a reflector having a predetermined reflective pattern.

23. The lamp assembly of claim 22 wherein said predetermined reflective pattern is a parabola.

* * * * *